US011485141B2

(12) United States Patent
Sakamoto

(10) Patent No.: US 11,485,141 B2
(45) Date of Patent: Nov. 1, 2022

(54) LIQUID EJECTION APPARATUS

(71) Applicant: SEIKO EPSON CORPORATION, Tokyo (JP)

(72) Inventor: Ryota Sakamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 16/774,798

(22) Filed: Jan. 28, 2020

(65) Prior Publication Data

US 2020/0247127 A1 Aug. 6, 2020

(30) Foreign Application Priority Data

Jan. 31, 2019 (JP) ..... JP2019-015245

(51) Int. Cl.
*B41J 2/165* (2006.01)

(52) U.S. Cl.
CPC .... *B41J 2/16535* (2013.01); *B41J 2002/1657* (2013.01); *B41J 2002/16573* (2013.01)

(58) Field of Classification Search
CPC .... B41J 2/16517; B41J 2/1707; B41J 2/1652; B41J 2/16552; B41J 2002/16502; B41J 2002/16529; B41J 2002/16597; B41J 2002/16573; B41J 2/16579
See application file for complete search history.

(56) References Cited

U.S. PATENT DOCUMENTS 6,595,611 B1 * 7/2003 Ruffino ..... B41J 2/165 347/23
2004/0165030 A1 8/2004 Sakamoto et al.
2008/0218554 A1 * 9/2008 Inoue ..... B41J 29/393 347/33
2017/0348970 A1 * 12/2017 Wakasa ..... B41J 2/04573

FOREIGN PATENT DOCUMENTS

JP 2004-276597 10/2004
JP 2018-187792 11/2018

* cited by examiner

*Primary Examiner* — Kristal Feggins
(74) *Attorney, Agent, or Firm* — Workman Nydegger

(57) ABSTRACT

A liquid ejection apparatus includes a liquid ejection head having a nozzle face in which a plurality of nozzles is opened, the plurality of nozzles ejecting liquid as a droplet, a cleaning unit configured to clean the nozzle face, an information receiving unit configured to receive input of a cleaning information that is information related to a frequency of cleaning of the nozzle face by the cleaning unit, and a controller configured to instruct the cleaning unit to perform the cleaning in accordance with the cleaning information.

4 Claims, 13 Drawing Sheets

FIG. 4

| VISCOSITY | EJECTION AMOUNT | LENGTH OF TAIL |
|---|---|---|
| LOW | MORE | SHORT |
| STANDARD | — | — |
| HIGH | LESS | LONG |

FIG. 5

52

THRESHOLD VALUE CHANGE UNTIL CLEANING

SET THRESHOLD VALUE UNTIL NEXT CLEANING.

| COLOR | REFERENCE VALUE | SET VALUE |
|---|---|---|
| Cy | 31680000 | 40000000 |
| Ma | 31680000 | 40000000 |
| Ye | 15840000 | 20000000 |

52

THRESHOLD VALUE CHANGE UNTIL CLEANING

SET THRESHOLD VALUE UNTIL NEXT CLEANING.

| COLOR | REFERENCE VALUE | SET VALUE |
|---|---|---|
| Cy | MEDIUM | LARGE |
| Ma | MEDIUM | LARGE |
| Ye | MEDIUM | SMALL |

52

THRESHOLD VALUE CHANGE UNTIL CLEANING

SET THRESHOLD VALUE UNTIL NEXT CLEANING.

| COLOR | THE NUMBER OF PRINTED SHEETS | REFERENCE VALUE | SET VALUE | CAPTURED IMAGE | REFERENCE IMAGE |
|---|---|---|---|---|---|
| Cy | 3 | MEDIUM | LARGE | | |

52

THRESHOLD VALUE CHANGE UNTIL CLEANING

SET THRESHOLD VALUE UNTIL NEXT CLEANING.

| COLOR | SET VALUE |
|---|---|
| Cy | 16000000 |

52

THRESHOLD VALUE CHANGE UNTIL CLEANING

SET THRESHOLD VALUE UNTIL NEXT CLEANING.

| COLOR | REFERENCE VALUE | SET VALUE | DEFECTIVE NOZZLE INFORMATION |
|---|---|---|---|
| Cy | 31680000 | 40000000 | 38400000 |
| Ma | 31680000 | 40000000 | 42000000 |
| Ye | 15840000 | 20000000 | 16000000 |

FIG. 18

| COLOR | ENVIRONMENT | SET VALUE |
|---|---|---|
| CYAN | 15°C | 41680000 |
| | 25°C | 31680000 |
| | 40°C | 21680000 |
| MAGENTA | 15°C | 41680000 |
| | 25°C | 31680000 |
| | 40°C | 21680000 |
| YELLOW | 15°C | 25840000 |
| | 25°C | 15840000 |
| | 40°C | 5840000 |

LIQUID EJECTION APPARATUS

The present application is based on, and claims priority from JP Application Serial Number 2019-015245, filed Jan. 31, 2019, the disclosure of which is hereby incorporated by reference herein in its entirety.

BACKGROUND

1. Technical Field

The present disclosure relates to a liquid ejection apparatus.

2. Related Art

There is known an ink jet recording apparatus that performs cleaning such as wiping of an ejection port face on which an ejection port of a recording head is formed (for example, JP-A-2004-276597). This ink jet recording apparatus compares the cumulative number of ejections from the ejection port with a preset cleaning performance threshold value, and performs cleaning when the cumulative number of ejections exceeds the cleaning threshold value.

However, when various conditions change in a case where the ink jet recording apparatus is used, for example, when the specification of the ink ejected from the ejection port has changed, the timing at which cleaning should be performed may also change. In the related art, the cleaning performance threshold value is set in advance corresponding to the ejection port from which predetermined ink is ejected. For this reason, when various conditions at the time of using the ink jet recording apparatus change, cleaning may not be performed at an appropriate timing. Such a problem is not limited to the ink jet recording apparatus, but is common to liquid ejection apparatuses that eject liquid.

SUMMARY

According to an aspect of the present disclosure, a liquid ejection apparatus is provided. The liquid ejection apparatus includes a liquid ejection head having a nozzle section formed with a plurality of nozzles that ejects liquid as a droplet, a cleaning unit that cleans the nozzle section, an information receiving unit that receives input of cleaning information that is information related to a frequency of cleaning of the nozzle section by the cleaning unit, and a controller that instructs the cleaning unit to perform the cleaning in accordance with the cleaning information.

BRIEF DESCRIPTION OF THE DRAWINGS

FIG. 4 is a table showing the relationship between viscosity and ejection characteristics of a liquid.

FIG. 5 is a diagram showing an example of a display when changing cleaning information in the first embodiment.

FIG. 18 is a table showing an example of a change in cleaning information according to a usage environment.

DESCRIPTION OF EXEMPLARY EMBODIMENTS

A. First Embodiment

Figure 1:
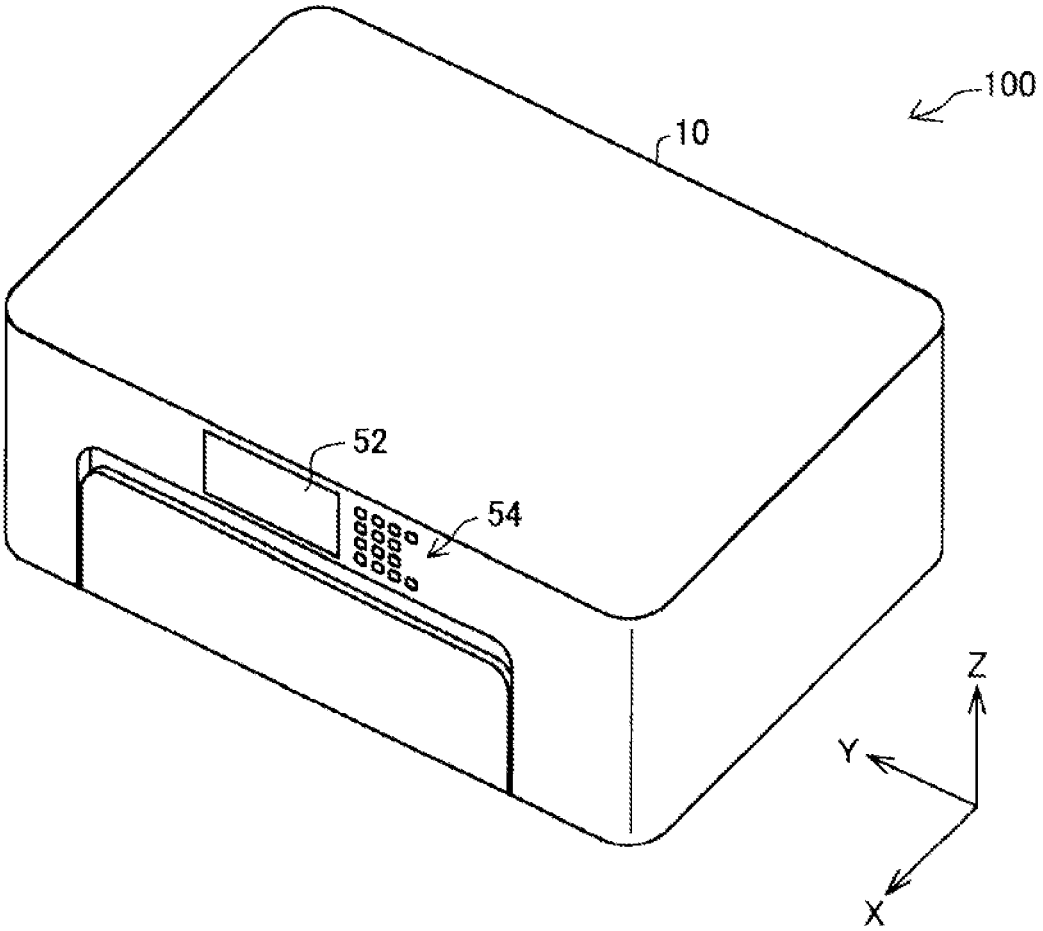
FIG. 1 is a schematic diagram illustrating an appearance of a liquid ejection apparatus according to a first embodiment.
Figure 2:
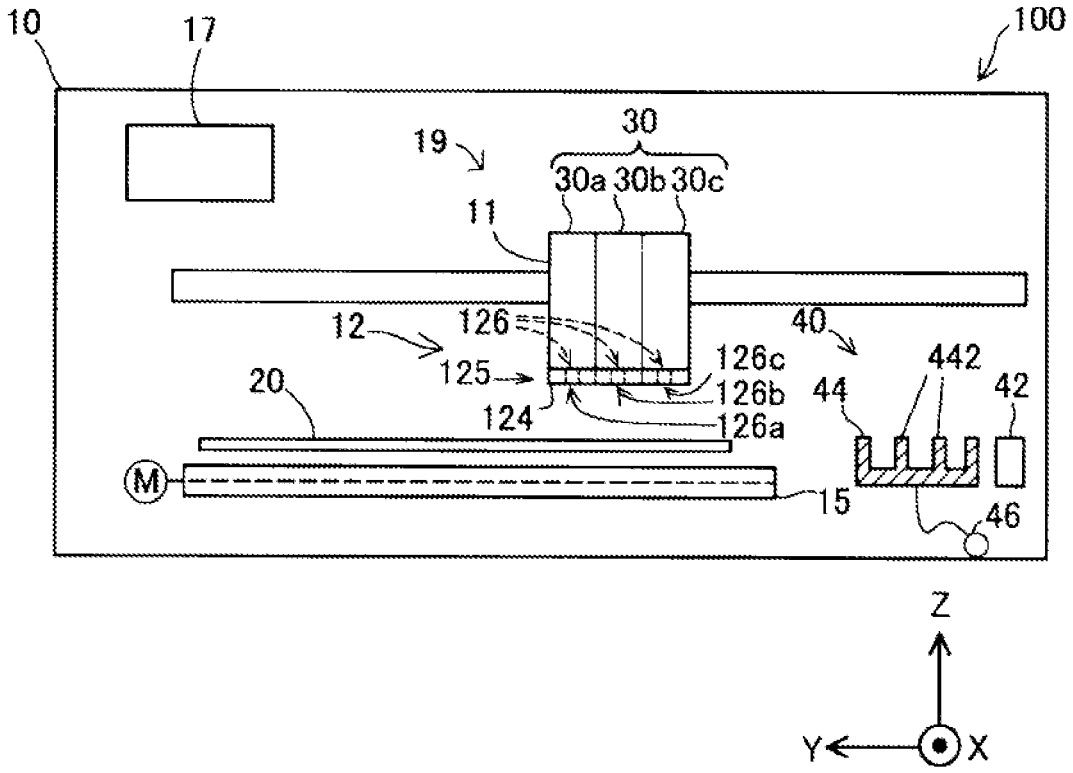
FIG. 2 is a schematic diagram illustrating an internal configuration of a liquid ejection apparatus.

FIG. 1 is a schematic diagram illustrating an appearance of a liquid ejection apparatus 100 according to the first embodiment. FIG. 2 is a schematic diagram illustrating an internal configuration of the liquid ejection apparatus 100. The liquid ejection apparatus 100 is a so-called ink jet printer, and performs printing on a medium 20 by ejecting ink as a liquid onto the medium 20. The medium 20 is a target for printing such as paper, a plate material, and cloth. For example, the ink may include a water-based ink or a solvent ink. In the embodiment, the water-based ink is used as the ink. FIG. 1 shows the X axis, the Y axis, and the Z axis, that is, three spatial axes that are orthogonal to each other. The direction along the X axis is taken as the X direction, the direction along the Y axis is taken as the Y direction, and the direction along the Z axis is taken as the Z direction. The liquid ejection apparatus 100 is installed on a plane parallel to the XY plane defined by the X direction and the Y direction. The −Z direction is a vertically downward direction, and the +Z direction is a vertically upward direction. In other drawings described below, the X axis, the Y axis, and the Z axis are attached as necessary.

As shown in FIG. 2, the liquid ejection apparatus 100 includes, in an outer shell 10, a transport mechanism 15 that transports the medium 20, a controller 17, a carriage 19, a head unit 12 mounted on the carriage 19, a liquid supply source 30 detachably mounted on the head unit 12, and a cleaning unit 40. The transport mechanism 15 has a motor M as a power source. The carriage 19 is coupled to a carriage motor via a drive belt (not shown), and is reciprocably attached along a carriage guide shaft 191 as the carriage motor rotates. The head unit 12 functions as a liquid ejection head that ejects liquid to the outside. The controller 17 controls various operations of the liquid ejection apparatus 100, for example, a printing operation. In the embodiment, the liquid supply source 30 is a liquid tank that is capable of storing a liquid therein.

The head unit 12 has, for example, a concave shape that opens in the +Z direction, and includes a mounting unit 11 in which a mounting space in which the liquid supply source 30 is mounted is formed. The liquid supply source 30 and the head unit 12 communicate with each other. The liquid in the liquid supply source 30 is supplied to the head unit 12.

The head unit 12 has a nozzle section 125 in which a plurality of nozzles 126 is formed. The nozzle 126 is formed in a nozzle face 124, of the head unit 12, that faces the medium 20. The nozzle 126 has an opening that ejects a liquid. The head unit 12 includes, corresponding to the nozzle 126, a pressure chamber (not shown) to which liquid is supplied from the liquid supply source 30 and a drive element that causes pressure fluctuations in the liquid in the pressure chamber by applying a drive pulse. The liquid is ejected from the nozzle 126 toward the medium 20 due to the pressure fluctuations of the liquid in the pressure chamber. The liquid ejected from the nozzle 126 lands on the medium 20.

The liquid supply source 30 includes a first liquid supply source 30*a*, a second liquid supply source 30*b*, and a third liquid supply source 30*c* each of which store liquids of different colors therein. The colors of the liquids stored in the first liquid supply source 30*a*, the second liquid supply source 30*b*, and the third liquid supply source 30*c* are cyan, yellow, and magenta, respectively.

The plurality of nozzles 126 is divided into a first nozzle group 126*a*, a second nozzle group 126*b*, and a third nozzle group 126*c* each of which ejects liquids of different colors. The first nozzle group 126*a*, the second nozzle group 126*b*, and the third nozzle group 126*c* ejects the liquids supplied from the first liquid supply source 30*a*, the second liquid supply source 30*b*, and the third liquid supply source 30*c*, respectively. The colors of the liquids ejected from the first nozzle group 126*a*, the second nozzle group 126*b*, and the third nozzle group 126*c* are cyan, yellow, and magenta, respectively. The nozzle section 125 includes the first nozzle section that ejects, for example, a cyan liquid that is a first color, and the second nozzle section that ejects, for example, a yellow liquid that is a second color, which is different from the first color. The first nozzle section is, for example, a portion, of the nozzle section 125, where the first nozzle group 126*a* is formed. The second nozzle section is, for example, a portion, of the nozzle section 125, where the second nozzle group 126*b* is formed. In the embodiment, each of the nozzle groups 126*a* to 126*c* that eject respective colors has a plurality of nozzles 126.

The cleaning unit 40 is used for cleaning that is performed to suppress the performance degradation of the head unit 12 and to recover the degraded function. The cleaning includes, for example, wiping, pressure/suction cleaning, and flushing. The cleaning unit 40 includes, for example, a wiper 42 that wipes the nozzle face 124. The cleaning unit 40 includes, for example, a cap 44 that covers the nozzle face 124 and a suction mechanism 46 attached to the cap 44. The cap 44 has a region that is not in direct contact with the nozzle face 124, and a space between the cap 44 and the nozzle face 124 is formed. The cap 44 has a dividing wall 442 that divides a space formed between the nozzle face 124 and the cap 44. The dividing wall 442 divides the space so that the spaces formed by the regions having the respective nozzle groups 126*a* to 126*c* in the nozzle face 124 are not in communication with each other. The wiper 42 can also wipe only part of the nozzle face 124. As a result, the cleaning unit 40 can perform cleaning at different timings for each of the nozzle groups 126*a* to 126*c*.

For example, the cleaning is performed in response to an operation from the user of the liquid ejection apparatus 100. Further, the cleaning may be performed in accordance with an instruction from the controller 17 when there is no instruction from the user. In the embodiment, the carriage 19 on which the head unit 12 is mounted moves to the cleaning unit 40 when cleaning is performed.

The wiping, which is one type of cleaning, is a process of wiping the liquid attached to the nozzle face 124 with the wiper 42. The attachment of the liquid to the nozzle face 124 occurs, for example, when part of the ejected liquid is turned to mist. Further, for example, the attachment of the liquid to the nozzle face 124 can occur when part of the ejected liquid rebounds from the medium 20. The meniscus in the nozzle 126 is more likely to break as the amount of liquid attached to the nozzle face 124 increases. When the meniscus is broken, an ejection failure in the head unit 12, for example, missing dots may occur. The wiping suppresses the occurrence of the ejection failure in the head unit 12 by wiping off the liquid attached to the nozzle face 124.

The controller 17 is configured as a computer having a CPU and a memory, and controls respective components of the liquid ejection apparatus 100 by the CPU reading and executing various programs and information stored in the memory, which is the storage unit. For example, the controller 17 controls the carriage 19, the transport mechanism 15, and the head unit 12 to cause the liquid ejection apparatus 100 to perform the ejection operation. In addition, the controller 17 instructs the cleaning unit 40 to perform cleaning in response to cleaning information that is information related to the frequency of cleaning of the nozzle section 125 by the cleaning unit 40. In the embodiment, the cleaning information is a set value of a threshold value for the cumulative number of ejections set to determine the frequency of cleaning. The set value of the threshold value for the cumulative number of ejections is set for each of the nozzle groups 126*a* to 126*c*. The cumulative number of ejections is the cumulative number of times the droplets are ejected from the nozzles 126 for each of the nozzle groups 126*a* to 126*c*. Specifically, in a case where each of the nozzle groups 126*a* to 126*c* has 400 nozzles 126, the cumulative number of ejections is 400 when each nozzle 126 ejects a droplet once. The controller 17 functions as a counting unit that counts the cumulative number of ejections that is the number of times droplets are ejected from each of the nozzle groups 126*a* to 126*c*. A control signal output from the controller 17 to the head unit 12 is used for counting the cumulative number of ejections by the controller 17. The controller 17 instructs the cleaning unit 40 to perform cleaning when the counted cumulative number of ejections reaches the threshold value. For example, when the cleaning is performed, the count of the cumulative number of ejections by the counting unit is reset to 0.

As shown in FIG. 1, the liquid ejection apparatus 100 includes, on the outer shell 10, a display unit 52 and an information receiving unit 54. The display unit 52 displays information about the liquid ejection apparatus 100 to the user. The information about the liquid ejection apparatus 100 is, for example, cleaning information.

The information receiving unit 54 receives input of information from the user. In the embodiment, the information receiving unit 54 is a push button, and outputs, to the controller 17, information corresponding to an operation from the user. A touch panel may be employed as the information receiving unit 54. In this case, the information receiving unit 54 may have a function as the display unit 52.

Figure 3:
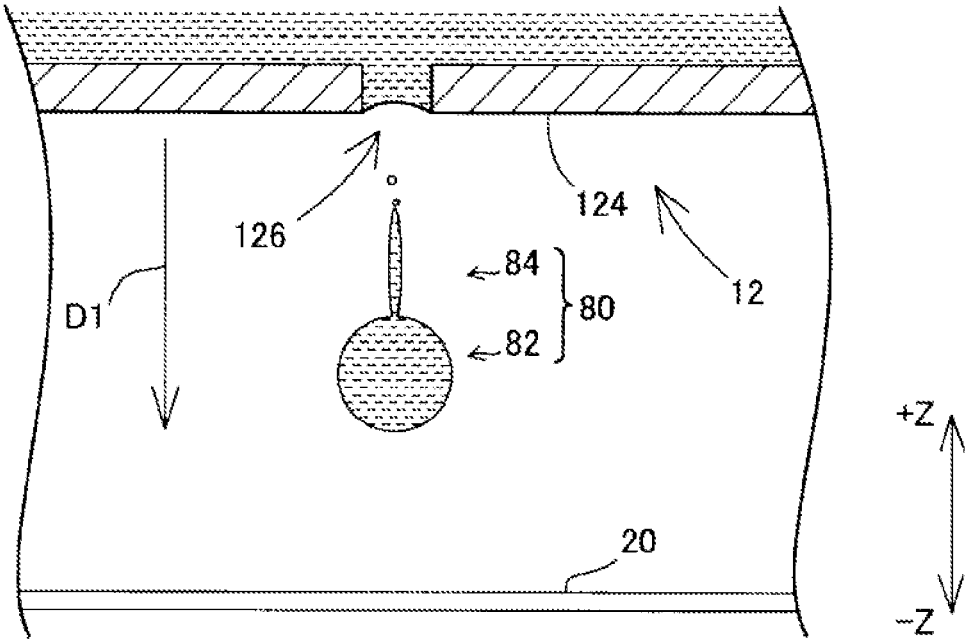
FIG. 3 is a schematic diagram showing a state of a droplet when a liquid is ejected from a nozzle.

FIG. 3 is a schematic diagram showing the state of a droplet 80 when the liquid is ejected from the nozzle 126. The droplet 80, which is the liquid ejected from the nozzle 126, has a main droplet 82 that occupies most of the ejected liquid and a tail 84 that is formed behind the main droplet 82 in an ejection direction D1. The tail 84 may be separated from the main droplet 82 before reaching the medium 20. The tail 84 separated from the main droplet 82 becomes a mist that is a minute droplet. The liquid turned to mist may scatter without reaching the medium 20 and be attached to the nozzle face 124. The longer the tail 84 is, more easily the tail 84 is separated from the main droplet 82, and the amount of liquid to be turned to mist increases. For this reason, the longer the tail 84 is, the more the amount of liquid attached to the nozzle face 124 tends to be. The liquid turned to mist tends to be attached to a position near the nozzle 126 that ejected the liquid on the nozzle face 124. For this reason, for the nozzle face 124, the surroundings of the nozzle 126 that ejects a liquid that tends to mist easily needs to be cleaned more frequently than the surroundings of the nozzle 126 that ejects a liquid that does not tend to mist easily.

FIG. 4 is a table showing the relationship between the viscosity and the ejection characteristics of a liquid. The ejection characteristics means the amount of liquid ejected, the length of tailing, and the like when the liquid whose viscosity is different from the standard viscosity is ejected from the head unit 12, for example, by a standard drive pulse with which a liquid having the standard viscosity can be ejected from the nozzle 126 with the standard amount of ejection. When the viscosity of the liquid is higher than the standard, the amount of liquid ejected is reduced and the tail 84 is shortened. On the other hand, when the viscosity of the liquid is lower than the standard, the amount of liquid ejected increases and the tail 84 is lengthened. The standard viscosity is a viscosity of the liquid assumed when the liquid ejection apparatus 100 is manufactured. The ejection characteristics are different when the surface tension of the liquid is different in addition to when the viscosity of the liquid is different. The possibility of mist formation for the liquid also changes due to the change in the ejection characteristics according to the surface tension. For example, when the surface tension is small, the liquid tends to mist easily, and when the surface tension is large, it does not tend to mist easily.

The liquid has a different viscosity or a different surface tension when the composition of the liquid supplied from the liquid supply source 30 is different. The composition of the liquid varies depending on the color of the liquid, for example. Moreover, even when the liquid has the same color, the liquid has a different composition when the company and equipment which manufacture the liquid differ. For this reason, for example, a liquid that is recommended by a company that manufactures the liquid ejection apparatus 100 and a liquid that is not recommended may have different viscosities or the surface tensions. Even for the liquid having the same composition at the time of manufacture, the viscosity or the surface tension of the liquid change, for example, when the liquid is altered in quality due to heat, drying, or aging. For example, when the liquid is altered in quality by heat or drying, the viscosity of the liquid increases.

When the viscosity or the surface tension of the liquid changes, the amount of liquid attached to the nozzle face 124 changes even with the same cumulative number of ejections. For this reason, according to the change in the viscosity of the liquid, the cumulative number of ejections required for the amount of liquid that requires cleaning to be attached to the nozzle face 124 changes. Specifically, as mentioned above, when ejecting the liquid with the standard drive pulse, the liquid with a viscosity lower than the standard viscosity tends to have a long tail and mist easily, and the cumulative number of ejections required for the amount of liquid that requires cleaning to be attached to the nozzle face 124 is smaller than that for a liquid with the standard viscosity. The liquid with a viscosity higher than the standard viscosity tends to have a short tail and suppress mist formation, and the cumulative number of ejections required for the amount of liquid that requires cleaning to be attached to the nozzle face 124 is greater than that for a liquid with the standard viscosity. However, generally, only the standard viscosity of a liquid cannot determine the tendency of mist formation of the liquid. For example, since a liquid with a viscosity higher than the standard viscosity has a smaller ejection rate with a standard drive pulse, the liquid may be ejected using a correction drive pulse that is corrected to increase the amount of ejection in order to make the amount of liquid ejected equal to the standard. When the liquid is ejected using the correction driving pulse which is corrected to increase the amount of ejection, the droplet flying speed increases as the amount of ejection increases, and the tail 84 is lengthened and the liquid tends to mist easily, so that the cumulative number of ejections required for the amount of liquid that requires cleaning to be attached to the nozzle face 124 is smaller than that for a liquid with the standard viscosity. In addition, the liquid with a viscosity lower than the standard viscosity has the increased amount of ejection with the standard driving pulse as described above, so that the liquid may be ejected using a correction drive pulse that is corrected to reduce the amount of ejection in order to make the amount of liquid ejected equal to the standard. When the liquid is ejected using the correction drive pulse which is corrected to reduce the amount of ejection, the droplet flying speed decreases as the amount of ejection decreases, and the tail 84 is shortened and mist formation tends to be suppressed, so that the cumulative number of ejections required for the amount of liquid that needs to be cleaned to be attached to the nozzle face 124 is greater than that for a liquid with the standard viscosity. Therefore, the occurrence of ejection failure is suppressed by setting a threshold value for the cumulative number of ejections for determining the frequency of cleaning according to the state of attachment of the liquid in use to the nozzle face 124.

FIG. 5 is a diagram showing an example of a change screen displayed on the display unit 52 when changing the cleaning information in the first embodiment. For example, when changing the liquid stored in the liquid supply source 30, specifically, for example, when exchanging the liquid supply source 30 or replenishing the liquid supply source 30 with liquid, the user displays the information shown in FIG. 5 on the display unit 52 using the information receiving unit 54. The information displayed on the display unit 52 includes a message to the user and a display related to cleaning information. The message to the user is a message prompting the user to perform an operation, which is "Set the threshold value for the next cleaning" in the embodiment.

The display related to the cleaning information includes the color of the liquid ejected from each of the nozzle groups 126*a* to 126*c*, the reference value of the cleaning information, and the set value that is the cleaning information. The reference value of the cleaning information is a reference value of a threshold value for the cumulative number of ejections that indicates a cleaning performance timing predetermined for each color. The set value, which is cleaning information, is a set value of the threshold value for the cumulative number of ejections that indicates the currently set cleaning performance timing. In the liquid color display according to the embodiment, Cy, Ma, and Ye refer to cyan, magenta, and yellow, respectively. The reference value of the cleaning information is a value set at the time of shipment of the liquid ejection apparatus 100 from the factory, and for example, the value set based on the viscosity or the surface tension of the liquid recommended by the manufacturer that manufactures the liquid ejection apparatus 100. The user can change the set value displayed on the display unit 52 for each color by using the information receiving unit 54. The changed set value is stored in the storage unit. The controller 17 uses the set value stored in the storage unit as a threshold value, and performs cleaning when the counted cumulative number of ejections reaches the threshold value. As described above, the cleaning performance frequency is changed by changing the timing at which the cleaning is performed in accordance with the changed cleaning information.

FIG. 5 shows an example in which the cleaning information setting is changed when the liquid supply source 30 is replenished with a liquid having a viscosity lower than that of the liquid used as the reference when determining the reference value. As mentioned above, when a liquid having a viscosity lower than the standard viscosity is ejected by a correction drive pulse having a voltage corrected to make the amount of ejection equal to the standard, the liquid does not tend to mist easily, so that the user can change the set value to a value larger than the reference value. As a result, it is possible to reduce the frequency of cleaning performed by the cleaning unit 40 and prevent the cleaning from being excessive. Conversely, in a case of using a liquid with a viscosity higher than the standard viscosity, when the liquid is ejected by the correction drive pulse that is corrected to make the amount of ejection equal to the standard as mentioned above, the liquid tends to mist easily, so that the user can change the set value to a value smaller than the reference value. As a result, it is possible to increase the frequency of cleaning performed by the cleaning unit 40 and prevent the cleaning from being insufficient.

According to the first embodiment described above, the liquid ejection apparatus 100 includes the information receiving unit 54 that receives input of cleaning information that is information related to the frequency of cleaning of the nozzle section 125 by the cleaning unit 40. For this reason, in the liquid ejection apparatus 100, the frequency of cleaning of the nozzle section 125 by the cleaning unit 40 is changed by changing the cleaning information. As a result, in a case where various conditions change when the liquid ejection apparatus 100 is used, when the liquid ejected from the nozzle 126 is changed to a liquid having a different composition in the embodiment, the frequency of cleaning can be changed. For this reason, when the liquid ejected from the head unit 12 is changed to a liquid having a different composition, the possibility that cleaning is not performed at an appropriate timing is reduced. Therefore, it is possible to suppress the occurrence of the ejection failure due to insufficient frequency of cleaning. Further, adverse effects caused by excessive frequency of cleaning, for example, excessive consumption of liquid due to cleaning and wear of the nozzle face 124 due to wiping are suppressed. Similarly, the frequency of cleaning can be changed so that cleaning is performed at an appropriate timing even when the viscosity or the surface tension of the liquid changes due to heat, drying, or aging, and the ejection characteristics change.

According to the first embodiment described above, when the cumulative number of ejections of each of the nozzle groups 126*a* to 126*c* reaches a set value as a threshold value, the controller 17 causes the cleaning unit 40 to perform cleaning. For this reason, the liquid ejection apparatus 100 makes it possible to control the cleaning performance timing in association with the set value as the cleaning information and the cumulative number of ejections. Even when the amount of droplets ejected in one print, that is, one printing job, the cumulative number of ejections has a high correlation with the amount of mist generated, compared with the time of ejection and the number of prints. Therefore, compared with the case of controlling the timing of performance of cleaning in association with the time when the ejection was performed or the number of printed sheets, it is possible to further reduce the possibility that the cleaning is not performed at an appropriate timing.

Further, according to the first embodiment described above, the cleaning information includes the first color cleaning information and the second color cleaning information. The information receiving unit 54 receives input of the first color cleaning information and the second color cleaning information. The first color cleaning information is information related to the frequency of cleaning of the first nozzle section that ejects the first color liquid by the cleaning unit 40, and is a set value of the threshold value for the cumulative number of ejections of the first color. The second color cleaning information is information related to the frequency of cleaning of the second nozzle section that ejects the liquid of the second color different from the first color by the cleaning unit 40, and is a set value of the threshold value for the cumulative number of ejections of the second color. The first color is one of a plurality of colors ejected by the nozzle section 125, for example, yellow. The second color is a color different from the first color among a plurality of colors ejected by the nozzle section 125, for example, magenta. For this reason, the liquid ejection apparatus 100 can change the frequency of cleaning using the first cleaning information and the second cleaning information set according to the liquids of the first color and the second color. Therefore, the liquid ejection apparatus 100 can change the frequency of cleaning for each color of the liquid.

B. Second Embodiment

Figures 6, 7:
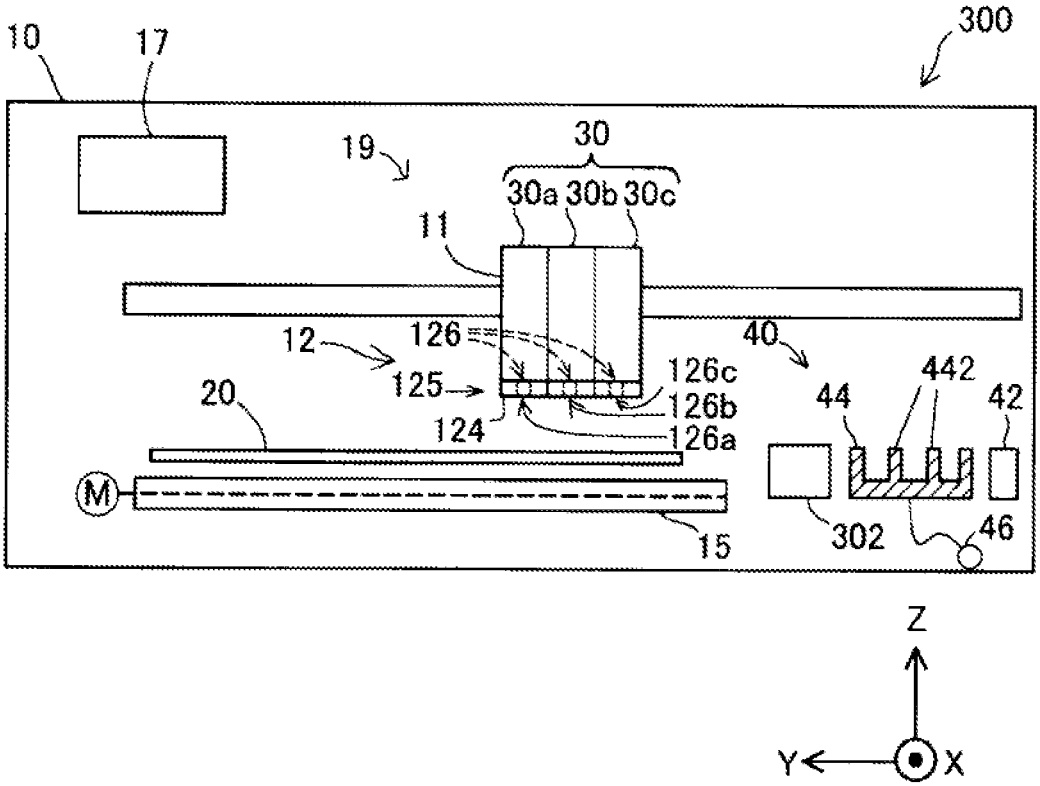
FIG. 6 is a diagram showing an example of a display when changing cleaning information in a second embodiment.
FIG. 7 is a schematic diagram illustrating an internal configuration of a liquid ejection apparatus according to a third embodiment.

FIG. 6 is a diagram illustrating an example of a change screen displayed on the display unit 52 when changing the cleaning information in the second embodiment. In the description of the second embodiment, configurations similar to those in the first embodiment are denoted by the same reference numerals, and detailed description thereof is omitted. In the liquid ejection apparatus 100 according to the second embodiment, when changing the liquid stored in the liquid supply source 30, information displayed on the display unit 52, specifically, the display related to cleaning information is different.

In the second embodiment, the display unit 52 also functions as an information display section that displays, for each color, a plurality of selections that is candidates for set values, which are cleaning information. In the embodiment, selections that are candidates for the cleaning information are not specific numerical values but the threshold value for the cumulative number of ejections with the reference value being "medium" is relatively indicated. Specifically, the three selections are represented by "small", which is a threshold value for the cumulative number of ejections smaller than the reference value, "medium", which a threshold value for the cumulative number of ejections equal to the reference value, and "large", which is a threshold value for the cumulative number of ejections larger than the reference value. For the three selections, a threshold value for the cumulative number of ejections corresponding each of them is set in advance. For example, the threshold value for the cumulative number of ejections corresponding to "small" is set to 80% of the reference value. Further, the threshold value for the cumulative number of ejections corresponding to "large" is set to 120% of the reference value. When the user uses the information receiving unit 54 to select a set value from these three selections, the input of cleaning information is received. The controller 17 changes the frequency of cleaning by using the threshold value of the cumulative number of ejections corresponding to the selection received by the information receiving unit 54 of the threshold values for the cumulative number of ejections set in advance according to cleaning information candidates. In the embodiment, the number of selections is three. However, the number of selections is not limited to this. For example, the number of selections may be two, or four or more. In addition, although the threshold value for the cumulative number of ejections is relatively indicated as the selection, the selection is not limited to this. The selection may be, for example, a specific numerical value as a candidate of the threshold value for the cumulative number of ejections. Alternatively, the selection may be, for example, a display that relatively indicates the performance frequency of cleaning.

The second embodiment described above has the same effect as the first embodiment in that it has the same configuration as the first embodiment. Furthermore, the liquid ejection apparatus 100 according to the second embodiment can display a plurality of selections as a candidate of cleaning information, and input cleaning information by performing one selection from among the selections. Therefore, it is possible to reduce time and labor when the user inputs cleaning information.

C. Third Embodiment

FIG. 7 is a schematic diagram illustrating an internal configuration of a liquid ejection apparatus 300 according to the third embodiment. In the description of the third embodiment, configurations similar to those in the first embodiment and the second embodiment are denoted by the same reference numerals, and detailed description thereof is omitted. The liquid ejection apparatus 300 according to the third embodiment differs from the liquid ejection apparatus 100 according to the first embodiment and the second embodiment in that an imaging unit 302 that images the nozzle face 124 is provided. Further, the liquid ejection apparatus 300 differs from the liquid ejection apparatus 100 according to the first embodiment and the second embodiment in the content of the process performed when changing the cleaning information.

The imaging unit 302 captures an image indicating the state of the nozzle face 124 used when the cleaning information is changed by the user. Various imaging devices including a general imaging device capable of capturing the image in the visible light region can be used as the imaging unit 302. Further, the imaging unit 302 may have a light source for irradiating the nozzle face 124 with light. The display unit 52 also functions as an image display unit that displays an image captured by the imaging unit 302.

In the embodiment, when the start of changing the cleaning information is instructed by the user's operation, a setting change process for changing the setting of the cleaning information is performed. In the setting change process in the embodiment, a captured image of the nozzle face 124 is displayed on the display unit 52 as a reference when changing the cleaning information. The captured image displayed in the setting change process is captured after printing a test pattern that is image data of a predetermined pattern. The number of test patterns to be printed can be changed. The number of test patterns to be printed is set by the user when instructing the start of changing the cleaning information.

Figure 8:
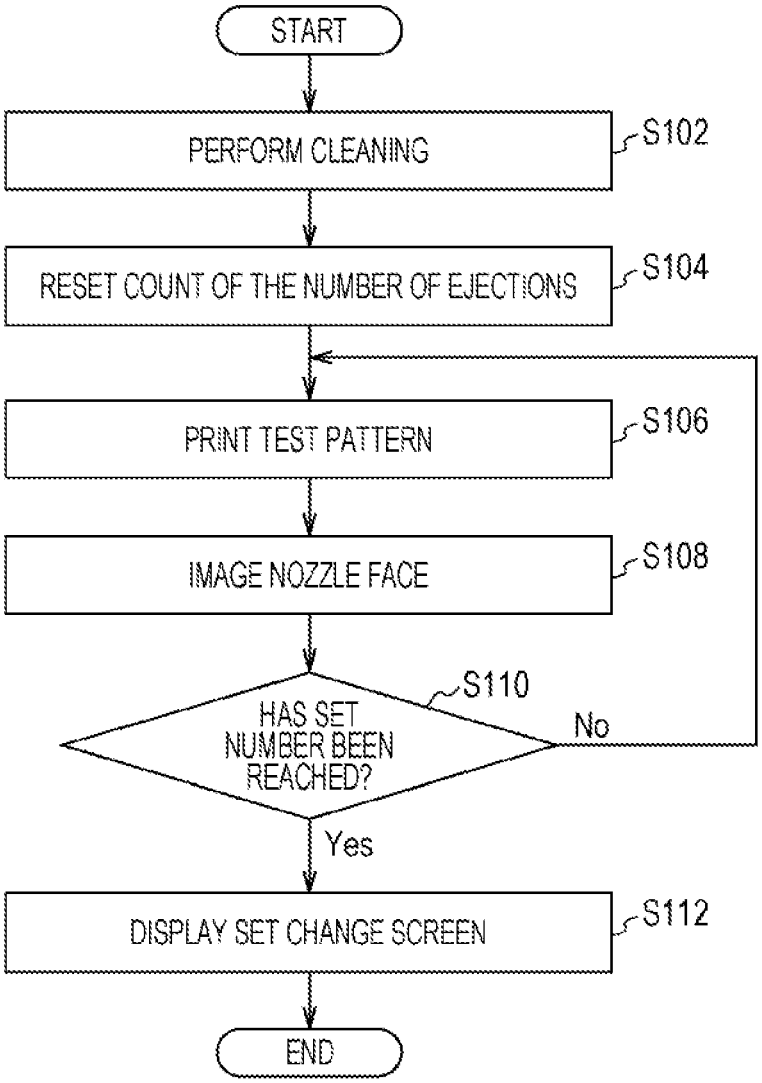
FIG. 8 is a flowchart of cleaning information change processing performed in the third embodiment.

FIG. 8 is a flowchart of a cleaning information setting change process performed in the third embodiment. The controller 17 starts the cleaning information setting change process in response to an instruction to start changing the cleaning information by the user's operation. When the process is started, first, the process of step S102 is performed.

In the process of step S102, the controller 17 instructs each component including the cleaning unit 40 to perform the cleaning process. The cleaning process performed in the embodiment includes at least wiping. Therefore, the liquid attached to the nozzle face 124 is removed before the process of changing the cleaning information set value is started. After the process of step S102, the controller 17 performs the process of step S104.

In the process of step S104, the controller 17 resets the count of the cumulative number of ejections. As a result, the cumulative number of ejections that was counted before the cleaning process in step S102 is reset, and the cumulative number of ejections is set to zero. After the process of step S104, the controller 17 performs the process of step S106.

In the process of step S106, the controller 17 instructs printing of the test pattern. The test pattern is an image of a predetermined pattern, and is an image in which the number of ejections necessary for printing is known. Image data indicating a test pattern is stored in advance in the liquid ejection apparatus 300. The test pattern is preferably an image in which the number of droplets ejected from each nozzle 126 is the same, for example, a solid pattern image. In the embodiment, the test pattern is an image of a solid pattern that fills the print area. In the embodiment, instead of printing a test pattern in step S106, a predetermined number of droplets can be ejected to the cap 44 or a flushing box (not shown). After the process of step S106, the controller 17 performs the process of step S108.

In the process of step S108, the controller 17 instructs the imaging unit 302 to image the nozzle face 124. The captured image captured by the imaging unit 302 is stored in the storage unit in a readable state. When the nozzle face 124 by the imaging unit 302 is imaged, the positional relationship between the imaging unit 302 and the nozzle face 124 is adjusted to a positional relationship in which it is possible to capture the image. Specifically, the carriage 19 moves so that the position of the head unit 12 is on the +Z direction side of the imaging unit 302. When the imaging unit 302 is movable, the positional relationship between the imaging unit 302 and the nozzle face 124 may be adjusted by moving the imaging unit 302. After the process of step S108, the controller 17 performs the process of step S110.

In step S110, the controller 17 determines whether the number of printed sheets of the test pattern has reached a preset number. The set number is the number set when the start of changing the cleaning information is instructed.

When the result of the process of step S110 is "No", that is, when the set number has not been reached, the controller 17 performs the process of step S106 again. Therefore, printing of the test image and imaging of the nozzle face 124 are repeated until the set number is reached. When the result of the process in step S110 is "Yes", that is, when the set number has been reached, the controller 17 performs the process in step S112.

In the process of step S112, the controller 17 causes the display unit 52 to display a change screen for changing the cleaning information. After the completion of step S112, the setting change process is terminated.

Figures 9, 10:
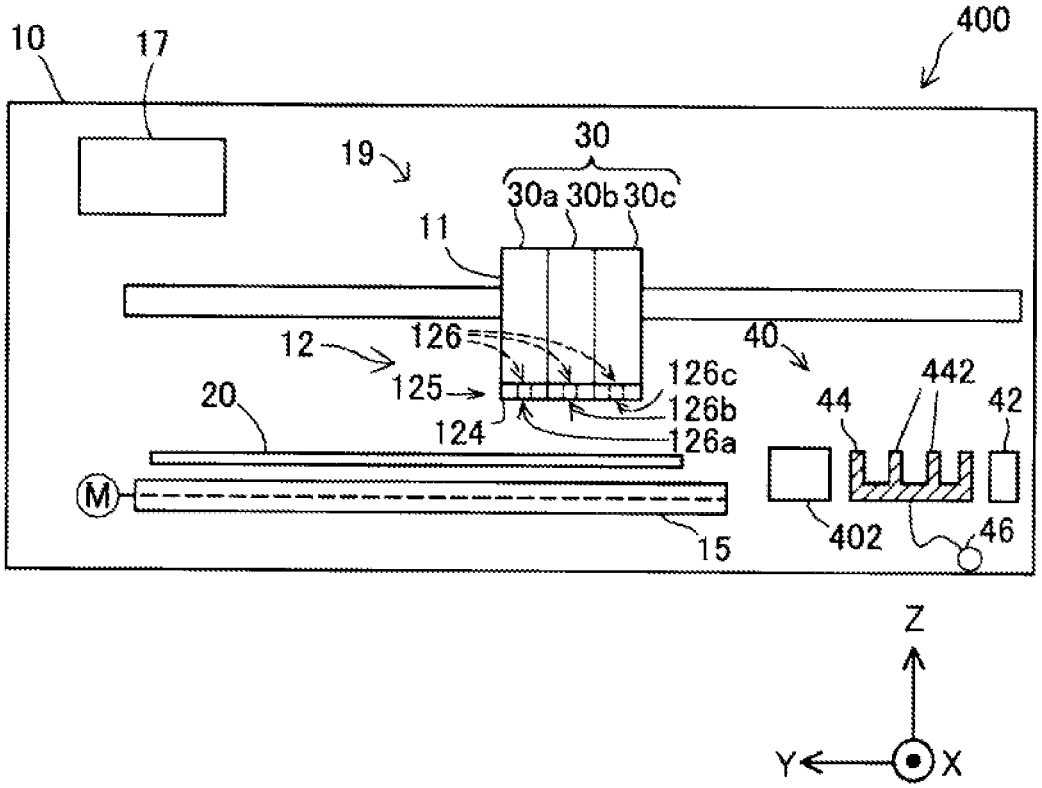
FIG. 9 is a diagram showing an example of a display when changing cleaning information in the third embodiment.
FIG. 10 is a schematic diagram illustrating an internal configuration of a liquid ejection apparatus according to a fourth embodiment.

FIG. 9 is a diagram illustrating an example of a change screen displayed on the display unit 52 when changing the cleaning information in the third embodiment. In the embodiment, a color whose setting is to be changed can be selected, and a reference value, a set value, the number of printed sheets, a captured image, and a reference image are displayed for the selected color. The number of printed sheets indicates how many test images are to be printed. The reference image is an image set as a reference for evaluating the captured image. The captured image is an image captured in step S108 in FIG. 8. The reference image is, for example, an image captured when ink whose specification is recommended by the manufacturer is used. The reference value and the set value are displayed in the same manner as in the second embodiment, and when the user selects the set value from the selections using the information receiving unit 54, the input of the cleaning information is accepted. The reference value and the set value may be displayed in the same manner as in the first embodiment, and a configuration in which when the user inputs a numerical value using the information receiving unit 54, the input of cleaning information is accepted may also be employed.

In the embodiment, the reference image and the captured image displayed on the display unit 52 shows a state where the cumulative number of ejections for them are the same, specifically, a state of the nozzle face 124 in a state where the same number of test patterns shown in the number of printed sheets are printed. The reference image and captured image to be displayed can be changed by the user's operation. The reference image and the captured image corresponding to the number of printed sheets changed by the user using the information receiving unit 54 are read from the storage unit by the controller 17 and displayed on the display unit 52. The reference image may not be displayed. Instead of or in addition to the reference image of the nozzle face 124, a captured image of the nozzle face 124 after cleaning in the period between step S102 and step S106 in FIG. 8 may be displayed as a reference image. The reference image may be an image showing the state of the nozzle face 124, for example, in a state where cleaning is necessary.

The third embodiment described above has the same effect as the first embodiment and the second embodiment in that it has the same configuration as the first embodiment and the second embodiment. Furthermore, when the user inputs cleaning information, the captured image of the nozzle face 124 can be referred to, so that the frequency of cleaning can be changed more appropriately.

D. Fourth Embodiment

FIG. 10 is a schematic diagram illustrating an internal configuration of a liquid ejection apparatus 400 according to the fourth embodiment. In the description of the fourth embodiment, configurations and processes similar to those in the first embodiment to third embodiment are denoted by the same reference numerals, and detailed description thereof is omitted. The liquid ejection apparatus 400 according to the fourth embodiment differs from the liquid ejection apparatuses 100 and 300 according to the first embodiment to the third embodiment in that it includes a liquid detection unit 402 that includes a sensor that detects the liquid attached to the nozzle face 124. Further, the liquid ejection apparatus 400 differs from the liquid ejection apparatuses 100 and 300 according to the first embodiment to the third embodiment in the content of the process performed when changing the cleaning information.

The liquid detection unit 402 is used to create information that indicates the amount of liquid attached to the nozzle face 124 and that is used when the cleaning information is changed by the user. Various sensors that is capable of detecting the liquid attached to the nozzle face 124 can be used as the sensor used in the liquid detection unit 402. Examples of the sensor used in the liquid detection unit 402 may include a distance sensor and an optical sensor. The distance sensor can detect liquid attached to the nozzle face 124, for example, according to a change in the distance from the distance sensor to the nozzle face 124 due to a droplet attached to the nozzle face 124. The optical sensor can detect liquid attached to the nozzle face 124, for example, according to a change in the reflectance of light on the nozzle face 124 due to a droplet attached to the nozzle face 124. In the embodiment, the liquid detection unit 402 includes the optical sensor. In this case, the liquid detection unit 402 includes a light source for irradiating the nozzle face 124 with light. Information detected by the liquid detection unit 402 is displayed on the display unit 52 that also functions as a detection information display section.

Figure 11:
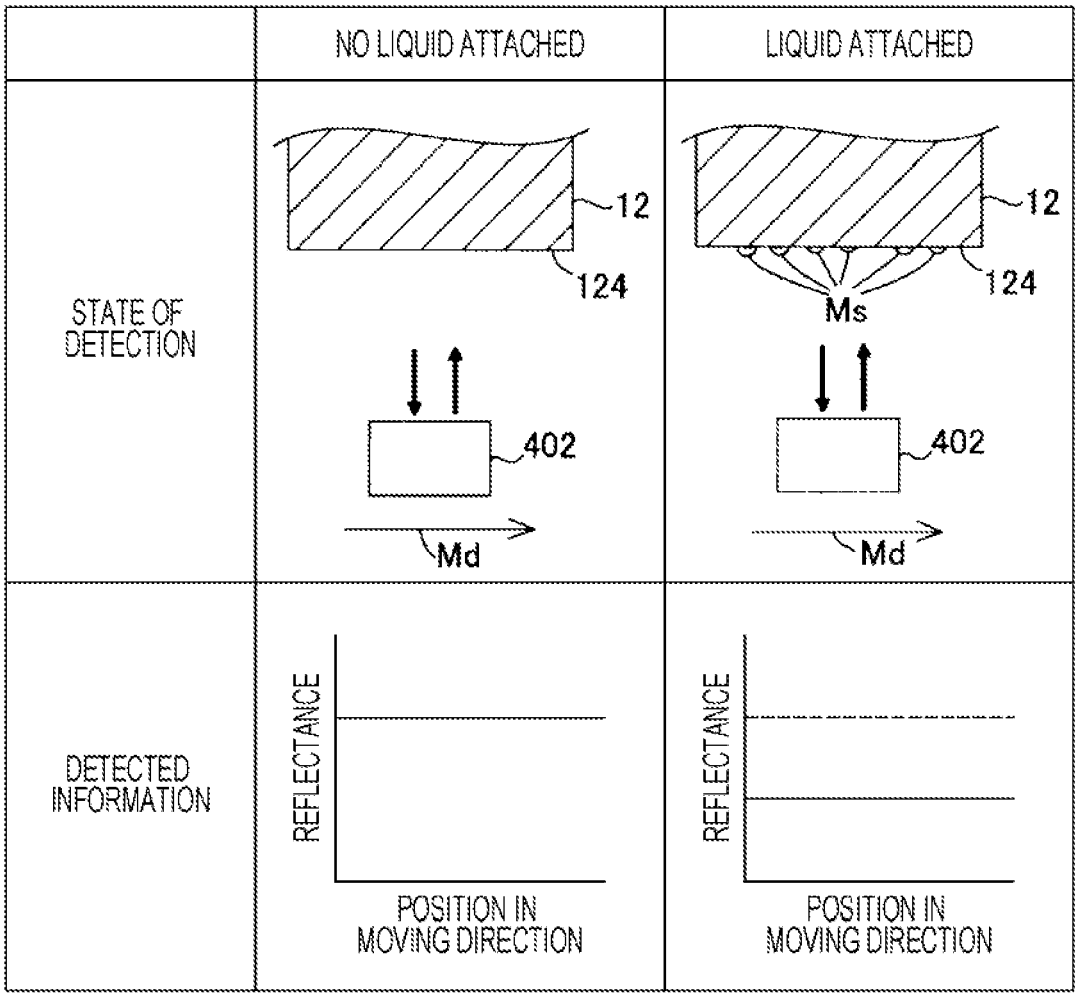
FIG. 11 is a table for comparing a state of liquid detection by a liquid detection unit when a droplet is not attached with a state of liquid when a droplet is attached.

FIG. 11 is a table for comparing the state of liquid detection by the liquid detection unit 402 between when the droplet Ms is not attached and when the droplet Ms is attached. The state of detection by the liquid detection unit 402 in each of when the droplet Ms is not attached and when the droplet Ms is attached is schematically shown in the upper side of the page of FIG. 11. The liquid detection unit 402 detects the presence or absence of the droplet Ms attached to the nozzle face 124 while moving along a movement direction Md. The movement direction Md is a direction in which the nozzle group 126 is arranged in the embodiment. In addition, information detected by the liquid detection unit 402 in each of when the droplet Ms is not attached and when the droplet Ms is attached is schematically shown in the lower side of the page of FIG. 11. The Information detected by the liquid detection unit 402 is shown as a graph in which the vertical axis represents the reflectance and the horizontal axis represents the position in the movement direction Md. The reflectance detected by the liquid detection unit 402 is indicated by a solid line in the graph. For comparison, the reflectance when the droplet Ms is not attached can also be indicated by a broken line in the graph. The reflectance detected by the liquid detection unit 402 when the droplet Ms is attached is smaller than that when the droplet Ms is not attached. This is because the reflectance of light of the liquid is lower than that of the nozzle face 124.

Figure 12:
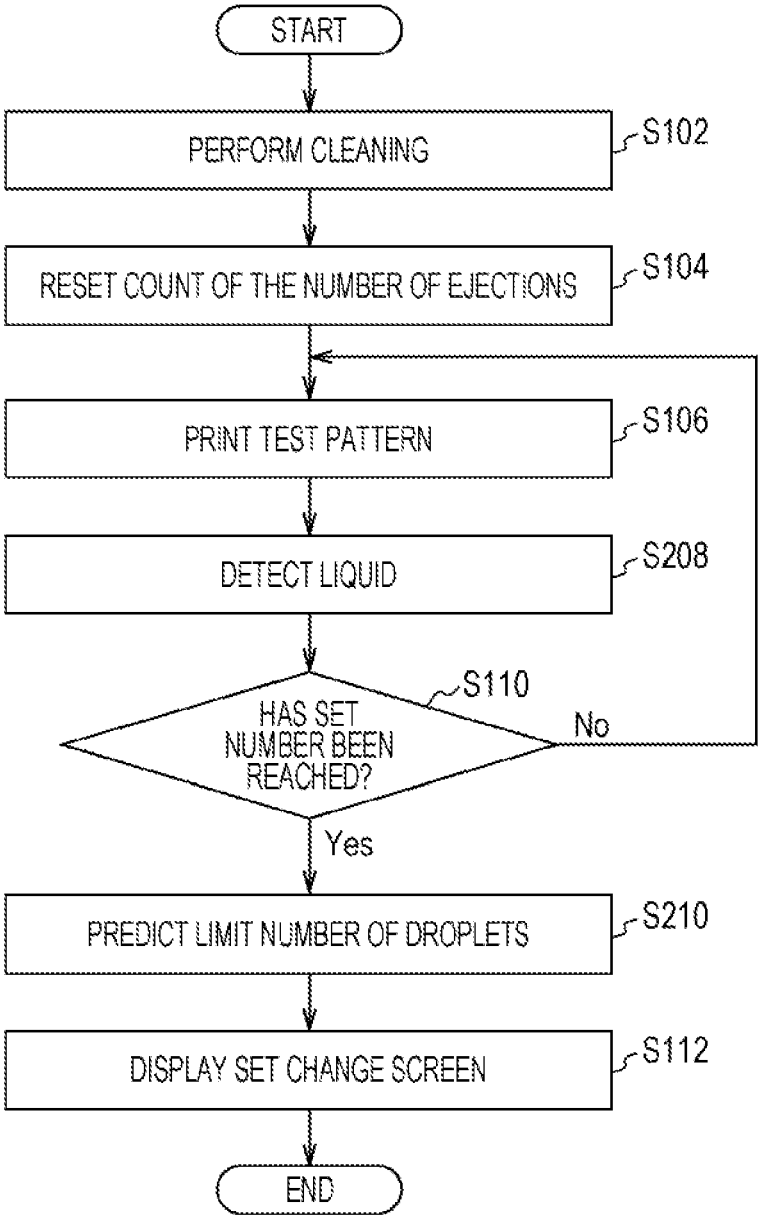
FIG. 12 is a flowchart of cleaning information change processing performed in the fourth embodiment.

FIG. 12 is a flowchart of a cleaning information setting change process performed in the fourth embodiment. The controller 17 starts the cleaning information setting change process in response to an instruction to start changing the cleaning information by the user's operation. When the process is started, first, the processes in steps S102 to S106 are performed as in the third embodiment. In the embodiment, instead of printing a test pattern in step S106, a predetermined number of droplets can be ejected to the cap 44 or a flushing box (not shown). After the process of step S106, the controller 17 performs the process of step S208.

In the process of step S208, the controller 17 instructs the liquid detection unit 402 to detect the liquid attached to the nozzle face 124. Information acquired by the liquid detection unit 402 is stored in the storage unit in a readable state. When the detection of the liquid attached to the nozzle face 124 is performed by the liquid detection unit 402, the positional relationship between the liquid detection unit 402 and the nozzle face 124 is adjusted to a positional relationship where the detection can be performed. Specifically, the carriage 19 moves so that the position of the head unit 12 is on the +Z direction side of the liquid detection unit 402. When the liquid detection unit 402 is movable, the positional relationship between the liquid detection unit 402 and the nozzle face 124 may be adjusted by moving the liquid detection unit 402. After the process of step S208, the controller 17 determines whether the number of printed sheets of the test pattern has reached a preset set number as step S110. When the result of the process at step S110 is "No", the controller 17 performs the process at step S106 again. When the result of the process in step S110 is "Yes", the controller 17 performs the process in step S210.

In the process of step S210, the controller 17 predicts the limit number of ejections, which is the cumulative number of ejections at which the risk of occurrence of ejection failure occurs. The prediction of the limit number of ejections is performed using the information acquired in step S208. For the prediction, it is possible to use a table, a statistical method, or the like for showing a relationship between the reflectance prepared in advance and the cumulative number of ejections. After the process of step S210, the controller 17 causes the display unit 52 to display a change screen for changing the cleaning information as the process of step S112. After the completion of step S112, the setting change process is terminated.

Figure 13:
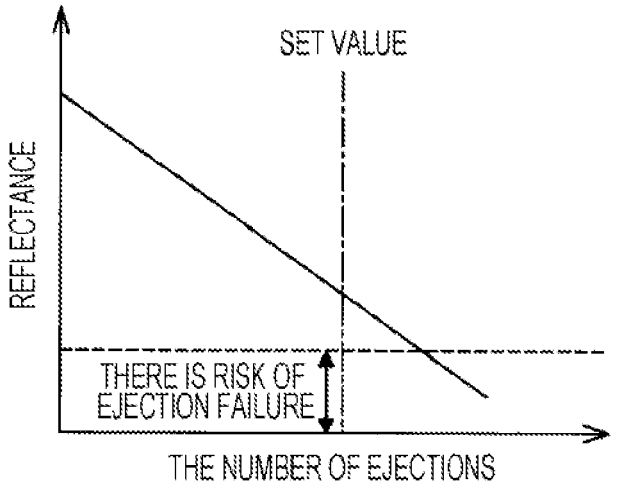
FIG. 13 is a diagram showing an example of a display when changing cleaning information in the fourth embodiment.

FIG. 13 is a diagram showing an example of a change screen displayed on the display unit 52 when changing the cleaning information in the fourth embodiment. The display unit 52 displays, as a display related to cleaning information, the color of the liquid ejected from each of the nozzle groups 126*a* to 126*c*, a set value, and a detection information display section for displaying information indicating a predicted value of the limit number of ejections. In the detection information display section for displaying information indicating the predicted value of the limit number of ejections, a graph showing the relationship between the reflectance detected by the liquid detection unit 402 and the cumulative number of ejections at the time of detection, a broken line indicating the reflectance at which the risk of occurrence of the ejection failure occurs, and a one-dot chain line indicating a set value are shown. When the set value is changed by the user's operation, the set value shown in the graph changes according to the change.

Figure 14:
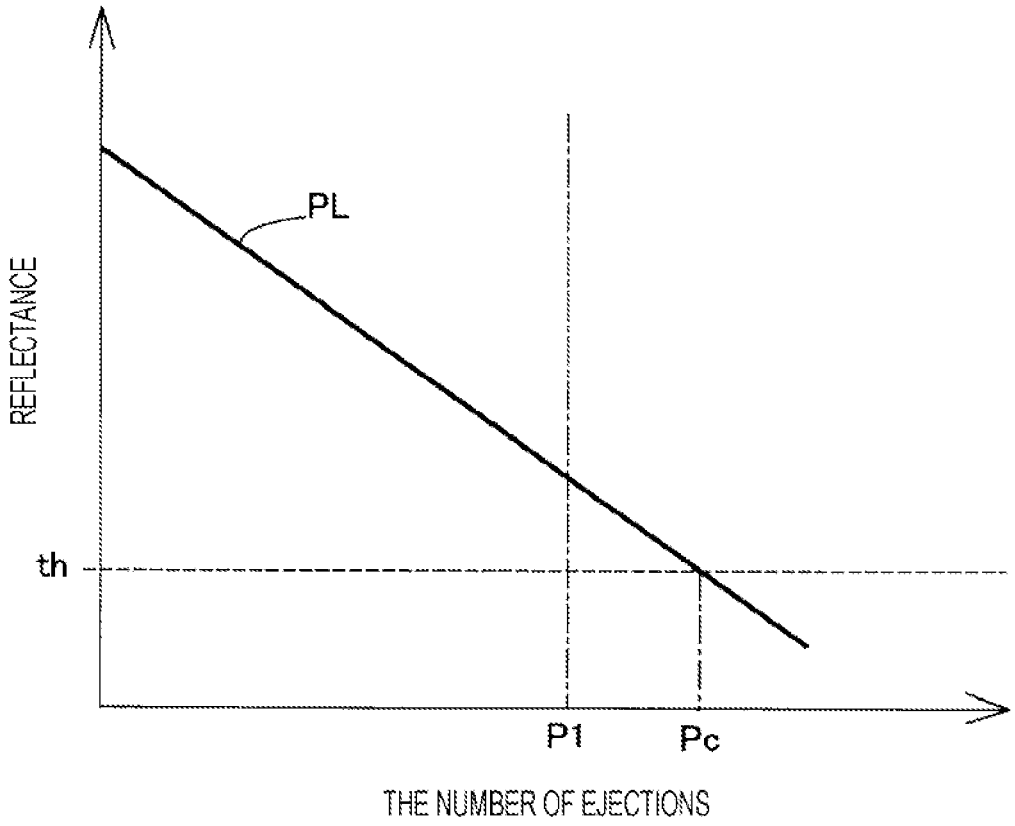
FIG. 14 is a diagram for explaining the graph shown in FIG. 13.

FIG. 14 is a diagram for explaining the graph shown in FIG. 13. A straight line indicating the relationship between the accumulated ejection amount and the reflectance detected by the liquid detection unit 402 is displayed in the graph shown on the display unit 52. In this graph, the vertical axis represents the reflectance, and the horizontal axis represents the cumulative number of ejections. A straight line PL indicating the relationship between the reflectance calculated by the controller 17 and the cumulative number of ejections is indicated by a solid line in accordance with the detection result by the liquid detection unit 402 in step S308. Further, a limit reflectance th corresponding to the amount of liquid, attached to the nozzle face 124, at which the ejection failure may occur is indicated by a broken line. When the reflectance is smaller than the limit reflectance th, it indicates that the risk of occurrence of the ejection failure is high. A set value P1 is indicated by a one-dot chain line. The limit reflectance th is obtained, for example, experimentally. For example, the limit reflectance th is determined in accordance with the distribution of the reflection intensity of the nozzle face 124 in a state in which the liquid is attached to the nozzle face 124 to the extent that the ejection failure begins to occur. The number of ejections Pc at which the straight line PL intersects the limit reflectance th corresponds to the limit number of ejections predicted as the cumulative number of ejections at which ejection failure starts to occur. The user can reduce the risk of occurrence of the ejection failure by setting the set value P1 to a value smaller than the number of ejections Pc.

The fourth embodiment described above has the same effect as the first embodiment to the second embodiment in that it has the same configuration as the first embodiment to the third embodiment. Furthermore, according to the fourth embodiment, information detected by the sensor that detects liquid attached to the nozzle face 124 can be referred to when the user inputs cleaning information. Therefore, the frequency of cleaning can be changed more appropriately.

E. Fifth Embodiment

In the description of the fifth embodiment, configurations and processes similar to those in the first embodiment to fourth embodiment are denoted by the same reference numerals, and detailed description thereof is omitted. The liquid ejection apparatus 100 according to the fifth embodiment differs from the liquid ejection apparatus 100 according to the first embodiment in that it includes a defect detection unit that detects, among a plurality of nozzles, a defective nozzle that does not normally eject liquid. Further, the liquid ejection apparatus 100 differs from the liquid ejection apparatuses 100, 300, and 400 according to the first embodiment to fourth embodiment in the content of the processing performed in changing the cleaning information.

The defect detection unit is used to create defective nozzle information used when the cleaning information is changed by the user. The defect detection unit is the controller 17 that functions as a piezoelectric element that is a drive element provided in the head unit 12 and a determination unit that detects a back electromotive force signal of the piezoelectric element to determine whether there is a ejection failure. The piezoelectric element functions as an actuator that ejects liquid from the nozzle 126, and as a sensor that detects residual vibration, which is the pressure fluctuations of the liquid in the pressure chamber when the piezoelectric element is driven. The defect detection unit detects an ejection failure based on, for example, a back electromotive force signal of the piezoelectric element due to residual vibration, which is pressure vibration generated in the ink in the pressure chamber when the piezoelectric element is driven. Information detected by the defect detection unit is displayed on the display unit 52 that also functions as a defect display section.

Figure 15:
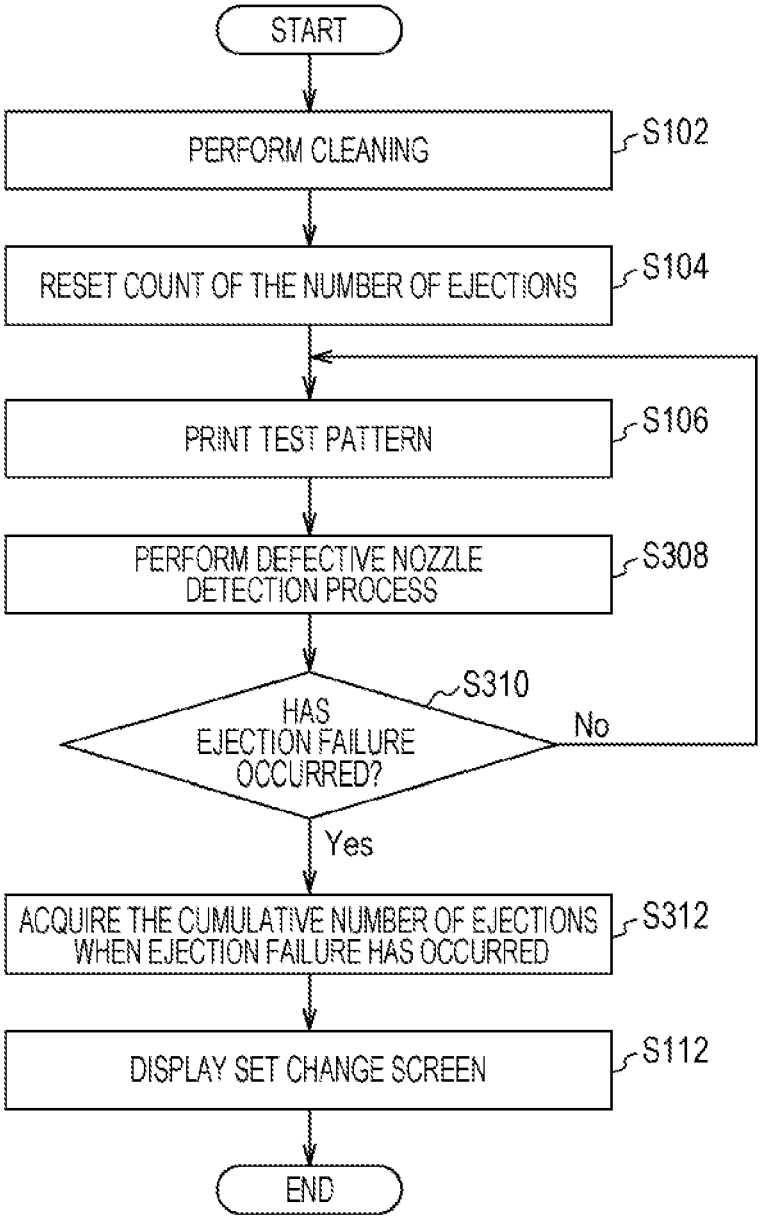
FIG. 15 is a flowchart of cleaning information change processing performed in a fifth embodiment.

FIG. 15 is a flowchart of a cleaning information setting change process performed in the fifth embodiment. The controller 17 starts the cleaning information setting change process in response to an instruction to start changing the cleaning information by the user's operation. When the process is started, first, the processes in steps S102 to S106 are performed as in the third embodiment. In the embodiment, instead of printing a test pattern in step S106, a predetermined number of droplets can be ejected to the cap 44 or a flushing box (not shown). After the process of step S106, the controller 17 performs the process of step S308.

In the process of step S308, the controller 17 performs the ejection failure detection process. As a result of the ejection failure detection process, for example, the cumulative number of ejections at the time of detection and the number of nozzles 126 at which the ejection failure has occurred are stored in the storage unit in a readable state. In the embodiment, the ejection failure detection process is performed by detecting a residual vibration that is the pressure fluctuations of the liquid in the pressure chamber when a drive signal, that is, a drive pulse is applied to the piezoelectric element corresponding to each nozzle 126. After droplets are ejected from each nozzle 126, the coupling of the piezoelectric element corresponding to each nozzle 126 is switched from the drive signal application circuit to the detection signal circuit, and the residual vibration is detected using the back electromotive force signal of the piezoelectric element due to the residual vibration of the liquid in the pressure chamber after the droplet ejection of each nozzle 126. The ejection failure detection process is not limited to this, and may be performed using various known ejection failure detection techniques. For example, an electrode member (not shown) is arranged inside the cap 44, an electric field is applied between the electrode member and the nozzle face 124, and the controller 17 acquires, as a detection signal, a voltage change from when the liquid is ejected from the nozzle 126 until when it lands. Based on the change in the detection signal, the controller 17 can determine the presence or absence of the ejection failure, or, for example, after a test pattern for the ejection failure inspection is printed on the medium 20, and the printed test pattern is imaged, the occurrence of the ejection failure may be determined using the captured image. When the test pattern is printed, the occurrence of the ejection failure may be determined using the weight of liquid consumed, or the occurrence of the ejection failure may be determined by optically detecting the liquid ejected from the nozzle 126.

After the process of step S308, the controller 17 determines whether the ejection failure has occurred in step S310. When the result of the process of step S310 is "No", that is, for example, when the number of nozzles 126 determined to be an ejection failure is less than a predetermined number, the controller 17 performs the process of step S106 again. When the result of the process of step S310 is "Yes", that is, for example, when the number of nozzles 126 determined to be an ejection failure is equal to or greater than a predetermined number, the controller 17 performs the process of step S312.

In the process of step S312, the controller 17 uses the result of step S308 to acquire, from the storage unit, the cumulative number of ejections when it is determined in step S310 that the ejection failure has occurred. After the process of step S312, the controller 17 causes the display unit 52 to display a change screen for changing the cleaning information as the process of step S112. After the completion of step S112, the setting change process is terminated.

Figures 16, 17:
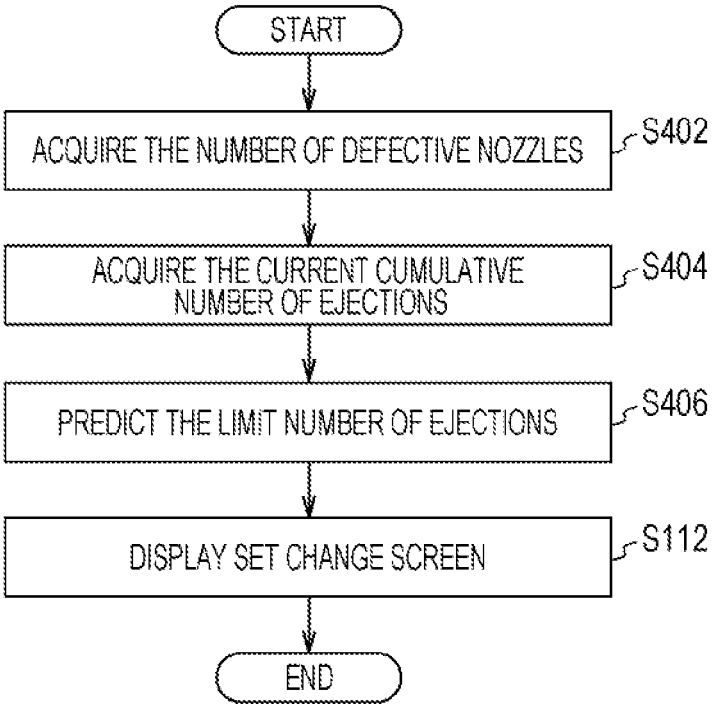
FIG. 16 is a diagram showing an example of a display when changing cleaning information in the fifth embodiment.
FIG. 17 is a flowchart of cleaning information change processing performed in a sixth embodiment.

FIG. 16 is a diagram illustrating an example of a change screen displayed on the display unit 52 when changing the cleaning information in the fifth embodiment. The display unit 52 displays, as a display related to cleaning information, the color of the liquid ejected from each of the nozzle groups 126*a* to 126*c*, a reference value of the cleaning information predetermined for each color, a set value that is the currently set cleaning information, and further, a defect display section that indicates defective nozzle information that is the cumulative number of ejections when it is determined that the ejection failure has occurred in the ejection failure detection process. The defective nozzle information is a value of the cumulative number of ejections when it is determined that the ejection failure acquired in step S312 of FIG. 15 has occurred.

The fifth embodiment described above has the same effect as the first embodiment to the fourth embodiment in that it has the same configuration as the first embodiment to the fourth embodiment. Furthermore, according to the fifth embodiment, defective nozzle information can be referred to when the user inputs cleaning information. The frequency of cleaning can be changed more appropriately.

F. Sixth Embodiment

In the description of the sixth embodiment, configurations and processes similar to those in the first embodiment to fifth embodiment are denoted by the same reference numerals, and detailed description thereof is omitted. The liquid ejection apparatus 100 according to the sixth embodiment differs in that the limit number of ejections, which is the cumulative number of ejections at which the risk of occurrence of ejection failure is generated, is predicted without printing a test pattern in the cleaning information setting change process.

FIG. 17 is a flowchart of a cleaning information setting change process performed in the sixth embodiment. The controller 17 starts the cleaning information setting change process in response to an instruction to start changing the cleaning information by the user's operation. When the process is started, first, the process of step S402 is performed.

In the process of step S402, the controller 17 acquires the number of defective nozzles. In the embodiment, the number of defective nozzles is input by the user using the information receiving unit 54. Specifically, for example, the user visually checks the number of defective nozzles occurring in the printed medium 20, and inputs the checked number using the information receiving unit 54 when giving an instruction to start changing the cleaning information. For the number of defective nozzles, the controller 17 may performs the ejection failure detection process using the defect detection unit that detects defective nozzles in the fifth embodiment, and the number of nozzles 126 at which the ejection failure, which is information detected by the process, occurs may be acquired as the number of defective nozzles. In this case, it is not necessary for the user to input the number of defective nozzles. After the process of step S402, the controller 17 performs the process of step S404. In the process of step S404, the controller 17 acquires the current cumulative number of ejections. After the process of step S404, the controller 17 performs the process of step S406.

In the process of step S406, the controller 17 predicts the limit number of ejections. The number of defective nozzles acquired in step S402 and the cumulative number of ejections acquired in step S404 are used for the prediction. Specifically, the limit number of ejections is calculated by, for example, Equation (1) shown below.

$$\text{the limit number of ejections} = \text{the cumulative number of ejections}/(\text{the number of defective nozzles}+1)\times\text{safety factor} \quad (1)$$

The reason why "1" is added to the number of defective nozzles in Equation (1) is to enable calculation of the limit number of ejections even when the number of defective nozzles is zero. The safety factor is a positive value less than one, and is set to a value of 0.1 to 0.9, for example. The equation for calculating the limit number of ejections is not limited to the above-described Equation (1), and another equation that is capable of calculating the limit number of ejections, which is the cumulative number of ejections at which the risk of occurrence of the ejection failure occurs, can be set as appropriate.

After step S406, the controller 17 performs the process of step S112. In the process of step S112, the controller 17 causes the display unit 52 to display a change screen for changing the cleaning information. The change screen is similar to the change screen of the fifth embodiment shown in FIG. 16, and the limit number of ejections calculated in step S406 instead of the defective nozzle information of the fifth embodiment is displayed. For this reason, the user can refer to the limit number of ejections when changing the cleaning information. After the completion of step S112, the setting change process is terminated.

The sixth embodiment described above has the same effect as the first embodiment to fifth embodiment in that it has the same configuration as the first embodiment to fifth embodiment. Further, according to the sixth embodiment, the test pattern is not printed in the cleaning information setting change process. Therefore, it is possible to reduce the liquid consumption due to the test pattern printing. In addition, the labor of the test pattern printing by the user is reduced.

G. Another Embodiment

G1. First Another Embodiment

In the above embodiment, the case where the cleaning information is changed according to the properties of the liquid such as the viscosity or the surface tension of the liquid is described. However, the cleaning information may be changed according to various conditions when the liquid ejection apparatus 100 is used, other than the liquid properties such as the viscosity or the surface tension of the liquid. For example, the cleaning information may be changed according to usage environment conditions at which the liquid ejection apparatuses 100, 300, and 400 are used. Specifically, for example, the information receiving unit 54 receives input of first environmental cleaning information and second environmental cleaning information. The first environmental cleaning information is used when the liquid ejection apparatuses 100, 300, and 400 are used in the first usage environment. The second environmental cleaning information is used when the liquid ejection apparatuses 100, 300, and 400 are used in a second usage environment different from the first environment.

Examples of the usage environment condition include humidity and temperature. For example, the drying of the liquid when the humidity is low proceeds more easily than that when the humidity is high. For this reason, when the liquid ejection apparatuses 100, 300, and 400 are used in environment with a low humidity, the viscosity of the liquid tends to increase, so that it is preferable to increase the frequency of cleaning. For example, the drying of the liquid when the temperature is high proceeds more easily than that when the temperature is low. For this reason, when the liquid ejection apparatuses 100, 300, and 400 are used in an environment with a high temperature, the viscosity of the liquid tends to increase, so that it is preferable to increase the frequency of cleaning. The change in the cleaning information according to the environment may be performed by the user's operation, or may be automatically performed by the controller 17. When the cleaning information is changed according to the environment, the liquid ejection apparatuses 100, 300, and 400 may include an environment acquisition unit that acquires environment information indicating the temperature and the humidity of the usage environment. The environment acquisition unit is, for example, a temperature sensor when temperature is used as the usage environment condition, and a humidity sensor when humidity is used as the usage environment condition. Since cleaning information set according to the usage environment can be used based on environmental information acquired by the environment acquisition unit, the liquid ejection apparatuses 100, 300, and 400 can change the frequency of cleaning more appropriately.

FIG. 18 is a table showing an example of changing the cleaning information according to the usage environment. In the example shown in FIG. 18, the usage environment condition is temperature. The controller 17 may use a cleaning information table set for each of a plurality of temperatures stored in the storage unit. For example, as shown in FIG. 18, a set value is set as cleaning information corresponding to the temperatures of 15° C., 25° C., and 40° C. in the cleaning information table stored in the storage unit. In this case, the first environmental cleaning information is cleaning information set at, for example, 15° C., and the second environmental cleaning information is cleaning information set at, for example, 25° C. In the example of FIG. 18, correction is made so that the higher temperature is, the smaller the threshold value for the cumulative number of ejections, which is a set value for determining the frequency of cleaning, is. The controller 17 changes the frequency of cleaning by using the cleaning information set at the temperature closest to the usage environment according to the environment in which the liquid ejection apparatuses 100, 300, and 400 are used. The controller 17 may change the cleaning information according to the usage environment by correcting the cleaning information according to the usage environment. For example, the controller 17 may store in advance a correction equation for a set value that is a threshold value for the cumulative number of ejections according to the usage environment. In this case, for example, by determining the value in the first usage environment, the controller 17 corrects the cleaning information of other usage environments including the second usage environment by a correction equation corresponding to the difference in usage environment.

Further, the cleaning information may be changed according to conditions other than the usage environment. For example, it may be changed according to the medium 20 used in the printing by the liquid ejection apparatuses 100, 300, and 400. Specifically, for example, the information receiving unit 54 receives input of first medium cleaning information and second medium cleaning information. The first medium cleaning information is used when the first medium is used as the medium 20 in the liquid ejection apparatuses 100, 300, and 400. The second medium cleaning information is used when the second medium different from the first medium is used as the medium 20 in the liquid ejection apparatuses 100, 300, and 400. The first medium and the second medium have different mist generation risks during printing. For example, when the first medium is plain paper and the second medium is a medium such as coated paper that is more easily charged than the first medium, there is a larger mist generation risk when the second medium is used. For this reason, when the medium 20 is the second medium that is coated paper, it is preferable to increase the frequency of cleaning. In addition, for example, the risk of mist generation varies depending on the ease of occurrence of liquid splash on the surface of the medium. As a result, the liquid ejection apparatuses 100, 300, and 400 can change the frequency of cleaning more appropriately by changing the cleaning information according to the medium 20 to be used.

G2. Second Another Embodiment

In the above embodiment, the cleaning information is set by the threshold value for the cumulative number of ejections. However, the cleaning information is not limited to this. The cleaning information may be set by various parameters as long as it is the parameter having a correlation with the risk of occurrence of the ejection failure. For example, the cleaning information may be set by a threshold value for the number of printed sheets and a threshold value for a usage period. When the cleaning information is set by a parameter other than the threshold value for the cumulative number of ejections, the controller 17 has a function of counting the number of printed sheets and the usage period as a counting unit.

G3. Third Another Embodiment

In the above embodiment, the cleaning information setting change process is started in response to the user's operation. However, the cleaning information setting change process may be automatically started. For example, it may be automatically started when the liquid supply source 30 is replaced or when the liquid supply source 30 is replenished with liquid. When automatically started, the risk in which the user forgets to change the cleaning information is reduced.

G4. Fourth Another Embodiment

In the above embodiment, the cleaning information is set in common for a plurality of cleaning processes such as wiping, pressurization/suction cleaning, and flushing. However, the cleaning information may be set for each type of cleaning. Specifically, for example, cleaning information related to the frequency of the wiping performance and cleaning information related to the frequency of the flushing performance may be set independently.

G5. Fifth Another Embodiment

In the above embodiment, the cleaning information includes the first color cleaning information and the second color cleaning information, and is set for each color of the ejected liquid. However, the cleaning information is not limited to this. For example, the cleaning information may be set in common for all colors. In this case, for example, common cleaning information may be set for all colors according to the color having the highest risk of the ejection failure.

G6. Sixth Another Embodiment

In the above embodiment, the set value of the cleaning information is changed by input by the user's operation. However, the set value of the cleaning information may be automatically changed by the controller 17. For example, when it is possible to predict the limit number of ejections that is predicted as the cumulative number of ejections at which ejection failure starts to occur as in the liquid ejection apparatus 400 according to the fourth embodiment, the controller 17 may automatically change the set value of the cleaning information to an appropriate value depending on the outcome of the prediction.

The first another embodiment to sixth another embodiment described above have the same effect as the first embodiment to the sixth embodiment in that they have the same configuration as the first embodiment to the sixth embodiment.

G7. Seventh Another Embodiment

The present disclosure can be applied not only to an ink jet printer but also to any liquid ejection apparatus that ejects various liquids including ink. For example, the present disclosure can be applied to the following various liquid ejection apparatuses.

(1) Image recording apparatus such as a facsimile machine
(2) Color material ejection apparatus used for manufacturing a color filter for an image display apparatus such as liquid crystal displays
(3) Electrode material ejection device used for electrode formation such as an organic electro luminescence (EL) display and a field emission display (FED)
(4) Liquid ejection apparatus that ejects a liquid containing a bio-organic material used for biochip manufacture
(5) Sample ejection device as a precision pipette
(6) Lubricating oil ejection device
(7) Resin liquid ejection device
(8) Liquid ejection apparatus that ejects lubricating oil with pinpoint accuracy to precision machines such as watches and cameras
(9) Liquid ejection apparatus that ejects a transparent resin liquid such as an ultraviolet curable resin liquid onto a substrate in order to form a micro hemispherical lens that is an optical lens used in an optical communication element or the like
(10) Liquid ejection apparatus that ejects an acidic or alkaline etching solution for etching a substrate or the like
(11) Other liquid ejection apparatuses including a liquid ejection head that ejects minute amount of droplets.

The term "droplet" refers to the state of the liquid ejected from the liquid ejection apparatus, and includes those having a tail that is granular, tear-like, or thread-like. The "liquid" herein may be any material that can be ejected by the liquid ejection apparatus. For example, the "liquid" may be a material in a state when the substance is in a liquid phase. The "Liquid" includes liquid materials having high or low viscosity and liquid materials such as sol, gel water, other inorganic solvents, organic solvents, solutions, liquid resins, and liquid metals. Further, the "liquid" includes not only a liquid as one state of a substance but also a liquid in which particles of a functional material made of a solid such as a pigment or metal particles are dissolved, dispersed or mixed in a solvent. Further, representative examples of the liquid include ink and liquid crystal as described in the above embodiment. Here, the ink includes various liquid compositions such as general water-based ink and oil-based ink, gel ink, and hot-melt ink.

The present disclosure is not limited to the above-described embodiments, and can be implemented with various configurations without departing from the spirit of the present disclosure. For example, since the technical features of the embodiments corresponding to the technical features in the modes described in SUMMARY are provided to solve some or all of the above-described problems or achieve some or all of the above-described effects, the technical features can be appropriately replaced or combined. Further, unless the technical features are described as essential items in the specification, the technical features may be appropriately deleted.

(1) According to an aspect of the present disclosure, a liquid ejection apparatus is provided. The liquid ejection apparatus includes a liquid ejection head having a nozzle section formed with a plurality of nozzles that ejects liquid as a droplet, a cleaning unit that cleans the nozzle section, an information receiving unit that receives input of cleaning information that is information related to a frequency of cleaning of the nozzle section by the cleaning unit, and a controller that instructs the cleaning unit to perform the cleaning in accordance with the cleaning information. For this reason, in the liquid ejection apparatus, the frequency of cleaning of the nozzle face by the cleaning unit is changed by changing the cleaning information. As a result, the frequency of cleaning can be changed in a case where various conditions change when the liquid ejection apparatus is used. Therefore, when various conditions at the time of using the liquid ejection apparatus change, the possibility that cleaning is not performed at an appropriate timing is reduced.

(2) The liquid ejection apparatus according to the above aspect may further includes a counting unit that counts the cumulative number of ejections that is the number of times the droplet is ejected by the nozzle section, wherein the cleaning information may be a set value that is a threshold value for the cumulative number of ejections, and wherein the controller may cause the cleaning unit to perform the cleaning when the cumulative number of ejections reaches the set value. According to the liquid ejection apparatus of this aspect, when the cumulative number of ejections reaches the set value, it is possible to cause the cleaning unit to perform cleaning.

(3) The liquid ejection apparatus according to the above aspect may further include an information display section that displays a plurality of selections as candidates for the cleaning information. According to the liquid ejection apparatus of this aspect, it is possible to reduce time and labor when the user inputs cleaning information.

(4) The liquid ejection apparatus according to the above aspect may further include an imaging unit that images a nozzle face in which the plurality of nozzles is opened of the nozzle section, and an image display unit that displays an image of the imaged nozzle face. According to the liquid ejection apparatus of this aspect, when the user inputs cleaning information, the image of the nozzle face can be referred to, so that the frequency of cleaning can be changed more appropriately.

(5) The liquid ejection apparatus according to the above aspect may further includes a sensor that detects liquid attached to a nozzle face in which the plurality of nozzles is opened of the nozzle section, and a detection information display section that displays information detected by the sensor. According to the liquid ejection apparatus of this aspect, information detected by the sensor that detects the liquid attached to the nozzle face can be referred to when the user inputs the cleaning information.

(6) The liquid ejection apparatus according to the above aspect may further includes a defect detection unit that detects, among the plurality of nozzles, a defective nozzle that does not normally eject liquid, and a defect display section that displays defective nozzle information detected by the defect detection unit. According to the liquid ejection apparatus of this aspect, the defective nozzle information can be referred to when the user inputs the cleaning information.

(7) In the liquid ejection apparatus according to the above aspect, the nozzle section may include a first nozzle section including a plurality of nozzles that ejects a first color liquid from the plurality of nozzles, and a second nozzle section including a plurality of nozzles that ejects a second color liquid different from the first color, wherein the cleaning information may include first color cleaning information that is information related to a frequency of cleaning of the first nozzle section by the cleaning unit, and second color cleaning information that is information related to a frequency of cleaning of the second nozzle section by the cleaning unit, wherein the information receiving unit may receive input of the first color cleaning information and the second color cleaning information as the cleaning information, and wherein the controller may instruct the cleaning unit to perform cleaning of the first nozzle section in accordance with the first color cleaning information, and may instruct the cleaning unit to perform cleaning of the second nozzle section in accordance with the second color cleaning information. According to the liquid ejection apparatus of this aspect, it is possible to change the frequency of cleaning using the cleaning information set according to the liquids of the first color and the second color.

(8) In the liquid ejection apparatus of the above aspect, the cleaning information may include first environmental cleaning information used when the liquid ejection apparatus is used in a first usage environment, and second environmental cleaning information used when the liquid ejection apparatus is used in a second usage environment different from the first usage environment. According to the liquid ejection apparatus of this aspect, it is possible to change the frequency of cleaning using the cleaning information set for each usage environment.

(9) In the liquid ejection apparatus of the above aspect, the cleaning information may include first medium cleaning information used when a first medium is used as a medium on which liquid ejected from the plurality of nozzles lands, and second medium cleaning information used when a second medium different from the first medium is used as the medium. According to the liquid ejection apparatus of this aspect, it is possible to change the frequency of cleaning using the cleaning information set according to the medium to be used.

The present disclosure can also be implemented in various forms other than the liquid ejection apparatus. For example, the present disclosure can be implemented in the form of a control method of the liquid ejection apparatus or a program used for controlling the liquid ejection apparatus.

What is claimed is:

1. A liquid ejection apparatus comprising:

a liquid ejection head having a nozzle face in which a plurality of nozzles is opened, and the nozzle face includes a first nozzle section in which nozzles that eject a first color liquid are opened, and a second nozzle section in which nozzles that eject a second color liquid different from the first color are opened, and the plurality of nozzles eject liquid as a droplet;

a cleaning unit configured to clean the nozzle face;

an information receiving unit configured to receive cleaning information that is information related to a frequency of cleaning of the nozzle face by the cleaning unit, and the cleaning information includes a first color cleaning information that is information related to a first frequency of cleaning of the first nozzle section by the cleaning unit, and a second color cleaning information that is information related to a second frequency of cleaning of the second nozzle section by the cleaning unit, wherein the first frequency and the second frequency are different; and a controller configured to instruct the cleaning unit to perform the cleaning in accordance with the cleaning information, and the controller instructs the cleaning unit to perform cleaning of the first nozzle section in accordance with the first color cleaning information, and the controller instructs the cleaning unit to perform cleaning of the second nozzle section in accordance with the second color cleaning information.

2. The liquid ejection apparatus according to claim 1, further comprising:

a counting unit configured to count a cumulative number of ejections that is the number of times the droplet is ejected from the plurality of nozzles, wherein the cleaning information is a set value that is a threshold value for the cumulative number of ejections, and wherein the controller causes the cleaning unit to perform the cleaning when the cumulative number of ejections reaches the set value.

3. The liquid ejection apparatus according to claim 1, wherein the cleaning information includes a first environmental cleaning information used when the liquid ejection apparatus is used in a first usage environment, and a second environmental cleaning information used when the liquid ejection apparatus is used in a second usage environment different from the first usage environment.

4. The liquid ejection apparatus according to claim 1, wherein the cleaning information includes a first medium cleaning information used when a first medium is used as a medium on which liquid ejected from the plurality of nozzles lands, and a second medium cleaning information used when a second medium different from the first medium is used as the medium.

* * * * *